US007789358B1

(12) United States Patent
Adams

(10) Patent No.: US 7,789,358 B1
(45) Date of Patent: Sep. 7, 2010

(54) BUCKET HANGER

(76) Inventor: Michael Sidney Adams, P.O. Box 394, Carbondale, CO (US) 81623

( * ) Notice: Subject to any disclaimer, the term of this patent is extended or adjusted under 35 U.S.C. 154(b) by 0 days.

(21) Appl. No.: 11/737,623

(22) Filed: Apr. 19, 2007

Related U.S. Application Data

(60) Provisional application No. 60/793,141, filed on Apr. 19, 2006.

(51) Int. Cl.
*E06C 7/14* (2006.01)
*E04G 3/00* (2006.01)
*A47H 1/10* (2006.01)

(52) U.S. Cl. ..... 248/211; 248/215; 248/303

(58) Field of Classification Search ..... 24/210, 24/211, 301–305, 3.13; 206/279, 287.1; 156/579; 248/311.2, 210, 211, 312.1, 313, 248/214, 215, 301–303, 304, 305, 306, 309.1; 224/268, 269; 220/630, 751, 752; 211/85.18, 211/85.21, 71.01
See application file for complete search history.

(56) References Cited

U.S. PATENT DOCUMENTS

| | | | | | |
|---|---|---|---|---|---|
| 1,200,936 | A | * | 10/1916 | Hall | 248/210 |
| 1,593,043 | A | * | 7/1926 | Stroecker | 248/210 |
| 1,661,837 | A | | 3/1928 | Little | |
| 2,252,639 | A | | 8/1941 | Miller | |
| 2,262,282 | A | | 11/1941 | Helgason | |
| 2,453,189 | A | | 11/1948 | Bogut | |
| 2,503,108 | A | | 4/1950 | Glandville | |
| 2,519,732 | A | | 8/1950 | Bartolat | |
| 2,519,980 | A | | 8/1950 | Renz | |
| 2,536,967 | A | | 1/1951 | Thurgate | |
| 2,991,037 | A | * | 7/1961 | Becher, Jr. | 248/211 |
| 3,094,304 | A | | 6/1963 | Linder, Jr. | |
| 3,313,507 | A | | 4/1967 | Belli | |
| 4,053,131 | A | | 10/1977 | Francis | |
| 4,091,976 | A | * | 5/1978 | Morse | 206/279 |
| 4,099,693 | A | | 7/1978 | Blann | |
| 4,186,903 | A | * | 2/1980 | Fazakerley | 248/210 |
| 4,342,479 | A | * | 8/1982 | Hofer | 206/279 |
| 4,396,174 | A | | 8/1983 | Continenza et al. | |
| 4,403,368 | A | | 9/1983 | Harper | |
| 4,577,820 | A | | 3/1986 | Michaud | |
| 4,858,977 | A | * | 8/1989 | Mitchell | 294/82.1 |
| 4,899,970 | A | | 2/1990 | Berzina | |
| 5,628,398 | A | * | 5/1997 | Jackson | 206/287.1 |
| 5,687,941 | A | | 11/1997 | Quintile | |
| 5,716,034 | A | | 2/1998 | Unkefer | |
| 5,797,571 | A | * | 8/1998 | Brophy | 248/210 |
| 6,454,147 | B1 | * | 9/2002 | Marks | 224/268 |
| 6,474,607 | B1 | | 11/2002 | Wilson | |
| 6,557,807 | B1 | * | 5/2003 | Belanger | 248/215 |
| 6,585,204 | B1 | | 7/2003 | Haertzen | |
| 7,343,647 | B1 | * | 3/2008 | Kinskey et al. | 24/3.13 |
| 2007/0272813 | A1 | * | 11/2007 | Monteleone et al. | 248/303 |
| 2007/0272814 | A1 | * | 11/2007 | Bardill et al. | 248/305 |

* cited by examiner

*Primary Examiner*—Amy J Sterling
*Assistant Examiner*—Tan Le
(74) *Attorney, Agent, or Firm*—Patent Law Offices of Rick Martin P.C; Rick Martin

(57) ABSTRACT

A two piece plastic paint can hook has a transverse bracket with an integral downward pointing bucket hook. A channel in the transverse bracket accepts a tip of a plastic rung hook. The rung hook is assembled through the channel, thus setting a stem of the rung hook in a pivoting mount in the transverse channel. The devise is suited to hang a paint can from either the left or the right side of a ladder rung.

1 Claim, 2 Drawing Sheets

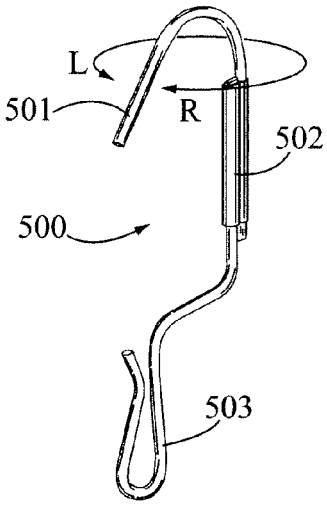
Fig. 5
(PRIOR ART)
Fig. 6
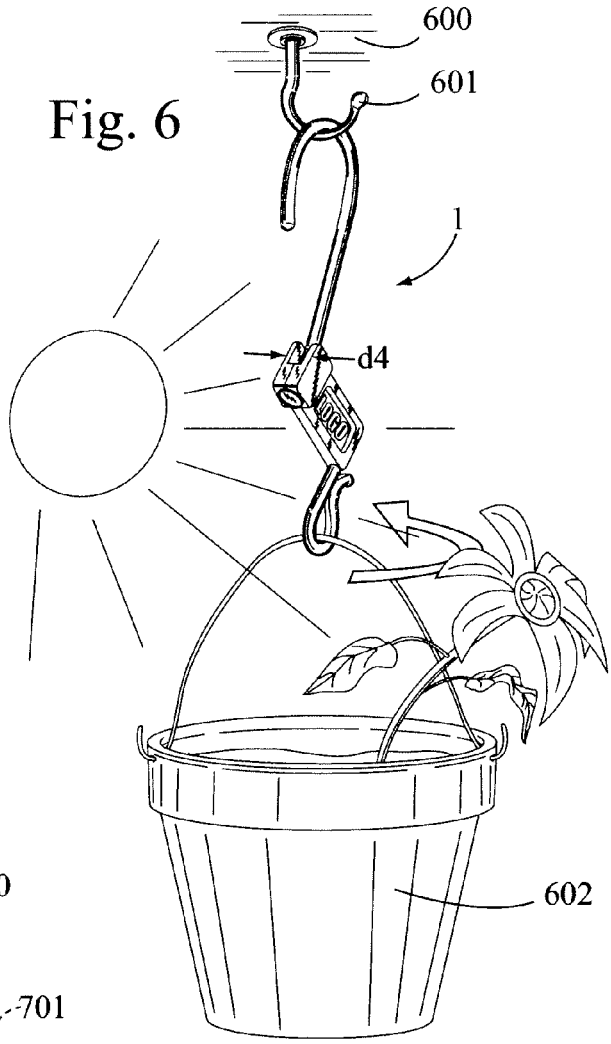
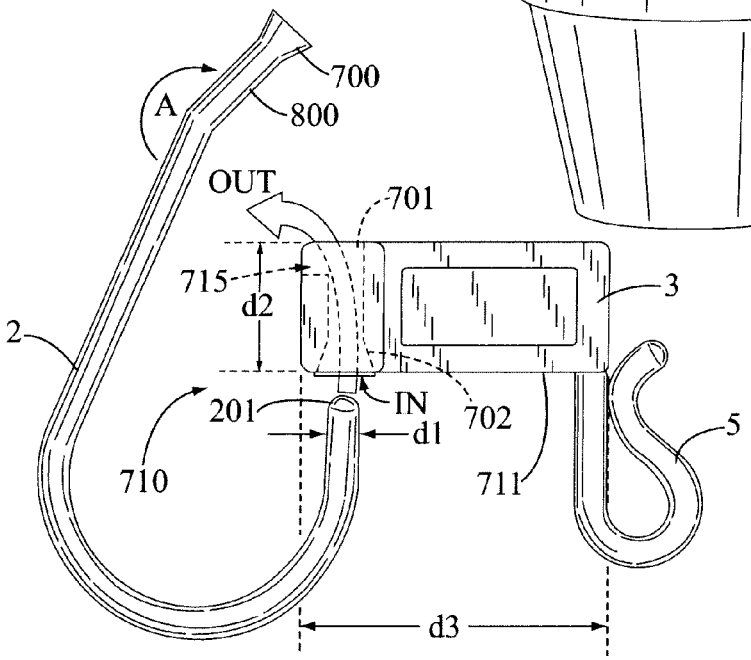
Fig. 7

BUCKET HANGER

CROSS REFERENCE APPLICATIONS

This application is a non-provisional application claiming the benefits of provisional application No. 60/793,141 filed Apr. 19, 2006.

FIELD OF INVENTION

The present invention relates to providing a hook/hanger for a bucket, such as a paint bucket, from the rung of a ladder or from any other structural support.

BACKGROUND OF THE INVENTION

Dozens of inventions exist which provide a hook on a ladder for a painter to hang his paint can from.

U.S. Pat. No. 2,453,189 (1948) to Bogut discloses a metal hook pivotally mounted to a metal plate 10. By pulling the base of the hook from the plate, the plate can be rotated 180°, thereby making the device useful on either the left or the right side of the ladder. At the opposite side of the plate a metal pin is supported. This pin has a lower loop from which a clip is supported. The paint can is clipped to the clip. The result is a paint can supported away from the rungs of the ladder. The paint can is supported to offer the painter a clear view of the paint level in the can as he dips his brush into the can. The device consists of about ten metal parts. The cost to produce would include the labor to assemble these parts.

U.S. Pat. No. 2,262,282 (1941) to Helgason discloses a bucket hanger for a painter that has a rung hook mounted in a transverse plate 9. The bucket hook is pivotally mounted in the same transverse plate 9 so as to be adjustable left or right. There are about seven pieces needed to produce the device including enlarged rings 11 used as stoppers.

What is needed in the art is a low cost injection molded bucket hanger, wherein the rung hook is pivotally mounted to a transverse bracket in a two piece construction. The present invention provides a single mold bracket and a single mold rung hook that is assembled into the bracket for final assembly. The bracket with its bracket hook can be pivoted left or right in use.

SUMMARY OF THE INVENTION

The main aspect of the present invention is to provide a two piece construction bucket hanger.

Another aspect of the present invention is to provide a pivoting swing hook to provide a left and right side use on a ladder.

Other aspects of this invention will appear from the following description and appended claims, reference being made to the accompanying drawings forming a part of this specification wherein like reference characters designate corresponding parts in the several views.

BRIEF DESCRIPTION OF THE DRAWINGS

Simplicity is the name of this invention. By providing a channel in the rung hook end of the transverse block, a rung hook can be pushed through the channel for final assembly. Thus, a pivotable bucket hook provides left or right side use. The entire assembly consists of only two molded pieces.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

FIG. 5 (prior art) is a perspective view of an early prototype.

FIG. 6 is a perspective view of the preferred embodiment in use as a plant holder.

FIG. 7 is an exploded view showing the assembly of two parts together.

DETAILED DESCRIPTION OF THE DRAWINGS

Figure 1:
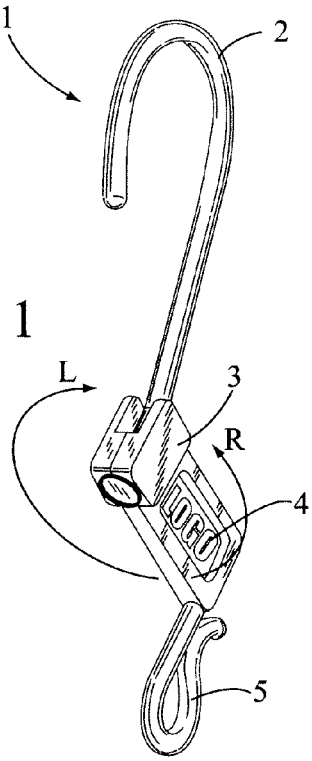
FIG. 1 is a perspective view of the preferred embodiment.

Referring first to FIG. 1 a bucket hanger 1 has a rung hook 2 pivotally mounted in a transverse block 3 as shown by arrows L, R. The center 4 of the block 3 is suited to have a logo mounted or molded thereon such a "Brand X" for paint. The stationary bucket hook 5 is integrally molded with the block 3. Preferably the method to produce parts 2 and 3 is a pin injection using a glass filled nylon resin. The bucket hook 5 is flexible to enable attachment of a bucket handle 30 as shown in FIGS. 3, 4.

Figure 2:
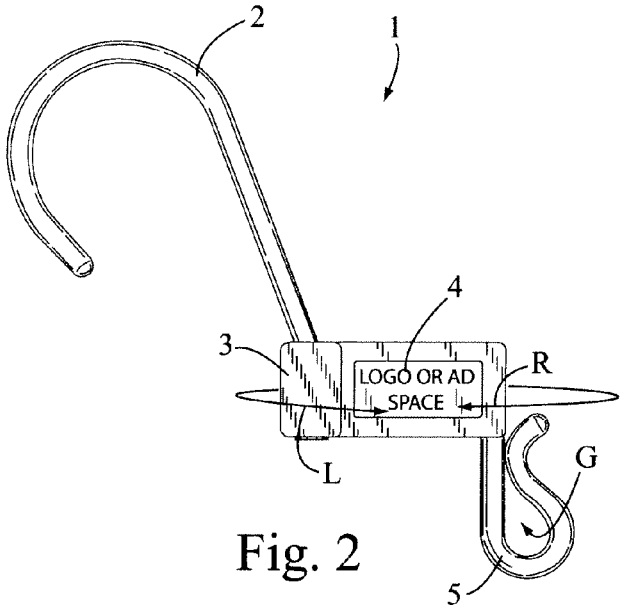
FIG. 2 is a side plan view of the preferred embodiment.

FIG. 2 shows the temporary gap G that is formed in the bucket hook 5 when the handle 30 is mounted/dismounted in the bucket hook 5.

Figure 3:
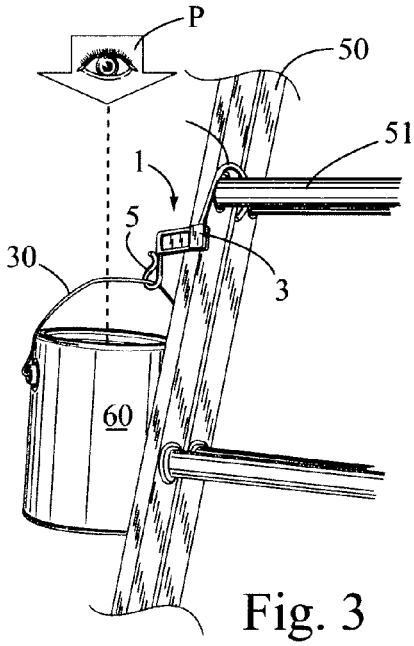
FIG. 3 is a perspective view of the preferred embodiment in use on the left side of a ladder.
Figure 4:
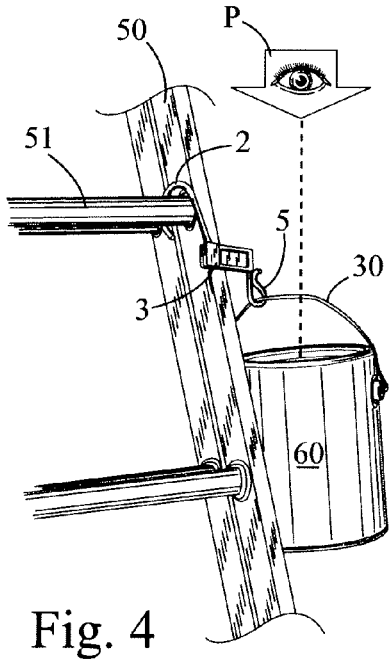
FIG. 4 is a perspective view of the preferred embodiment in use on the right side of the ladder.

Referring next to FIGS. 3, 4 the ladder 50 has a rung 51 from which the rung hook 2 is suspended. In use it is convenient to transfer the paint can 60 from the left to the right side of the ladder as shown. All the painter has to do is lift the rung hook 2 and place the transverse block as shown in FIG. 2.

The painter's eye P can look into the paint can 60 to help dip his paintbrush. This is more convenient than a device that supports the paint can behind the rung 51.

An early prototype 500 is shown in FIG. 5. The rung hook 501 pivots in metal collar 502. This allows the bucket hook 503 to move from a left to right side orientation. The three parts are metal. They cost considerably more to make than the preferred embodiment of FIG. 1. No logo area is provided.

In FIG. 6 a ceiling 600 has a ceiling hook 601. The bucket hanger 1 allows the user to adjust the position of the plant bucket 602 to better catch the sunshine during the day.

Referring last to FIG. 7 the transverse block 3 has an end 710 opposite the bucket hook 5. The bucket hook 5 depends from the bottom 711. A channel 701 starts at the bottom 711 with an enlarged opening 702. The channel rises upward to form an exit opening 715. The tip 201 of rung hook 2 is assembled into opening 702 as shown by arrow IN. The hook 2 is threaded all the way through channel 701 as shown by arrow OUT. The bulb or stop 700 lodges in opening 702. Then the bulb 700 and stem 800 pivot in channel 701. Nominally angle A=115°, D1=¼ inch, D2=1 inch, D3=2⅜ inch, D4=½ inch (FIG. 6). The offset angle A serves to move the transverse bracket 3 away from the tip 201, thus keeping the paint can 60 further from the rung 51 of the ladder 50 in FIGS. 3, 4.

Although the present invention has been described with reference to preferred embodiments, numerous modifications and variations can be made and still the result will come within the scope of the invention. No limitation with respect to the specific embodiments disclosed herein is intended or should be inferred. Each apparatus embodiment described herein has numerous equivalents.

I claim:

1. A hanger comprising:

a one piece plastic transverse bracket having a stationary bucket hook depending from one side thereof;

said transverse bracket having a vertical channel sized to accept a plastic rung hook therethrough, said vertical channel located on a side opposite the stationary bucket hook and orientated in an upward direction from the transverse bracket opposite from the downward direction of the bucket hook;

said rung hook shaped like a question mark suited to fit over a ladder rung;

wherein a tip of the rung hook is threaded through the vertical channel bottom so as to place a stop of the rung hook at a bottom of the transverse bracket; and wherein the rung hook pivots horizontally 360° in the vertical channel with its tip facing downward when hung around a rung of a ladder;

wherein said rung hook has an angled stem mounted in the vertical channel, said angled stem extends at an obtuse angle from the vertical channel when the rung hook is oriented away from the bucket hook, thereby moving the transverse bracket and its stationary bucket hook away from the tip of the stem;

wherein the stationary bucket hook further comprises an integral molded plastic formation with the transverse bracket; and said bucket hook having a flexible end that opens into a gap suited to support a paint bucket handle.

* * * * *